US007341487B2

(12) United States Patent
Wu

(10) Patent No.: US 7,341,487 B2
(45) Date of Patent: Mar. 11, 2008

(54) ELECTRICAL CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,753

(22) Filed: Jul. 5, 2006

(65) Prior Publication Data

US 2008/0009189 A1 Jan. 10, 2008

(51) Int. Cl.
*H01R 13/648* (2006.01)

(52) U.S. Cl. ..... 439/607; 439/497; 439/610

(58) Field of Classification Search ..... 439/607, 439/497, 610

See application file for complete search history.

(56) References Cited

U.S. PATENT DOCUMENTS 4,582,384 A * 4/1986 Frantz et al. ..... 439/610
5,934,942 A * 8/1999 Patel et al. ..... 439/610
6,004,150 A * 12/1999 Chapman et al. ..... 439/189
6,139,365 A * 10/2000 Lok ..... 439/607
6,210,229 B1 * 4/2001 Lai ..... 439/610
6,290,530 B1 * 9/2001 Chang ..... 439/378
6,599,151 B2 * 7/2003 Chiran et al. ..... 439/610
6,821,140 B2 * 11/2004 Wu ..... 439/362
6,916,198 B2 * 7/2005 Wu et al. ..... 439/497
6,948,965 B2 * 9/2005 Kumamoto et al. ..... 439/358
7,267,579 B1 * 9/2007 Wu ..... 439/610
2004/0102076 A1 5/2004 Wu

* cited by examiner

*Primary Examiner*—Hae Moon Hyeon
(74) *Attorney, Agent, or Firm*—Wei Te Chung

(57) ABSTRACT

An electrical connector assembly (100) includes a shielding shell (5), a connector housing (1) received in the shielding shell, a number of contacts (2) received in the connector housing, a printed circuit board (3) attached to the connector housing and electrically connected to the contacts, a cable (4) comprising a number of conductors (40) electrically attached to the printed circuit board, and a protecting cover (6) surrounding the shielding shell, the printed circuit board and the cable.

19 Claims, 6 Drawing Sheets

ELECTRICAL CONNECTOR ASSEMBLY

BACKGROUND OF THE INVENTION

1. Field of the Invention

The present invention relates generally to an electrical connector assembly, and more particularly to an electrical connector assembly for transmitting high-speed signals in an interconnection system.

2. Description of Related Arts

In the days of analog, VGA and S-VGA were the only interfaces required for computer displays. In the last several years, the PC and Consumer Electronics (CE) industries have developed a cornucopia of standards designed to support every type of digital signal that has been developed. Manufacturers have worked very hard to address every type of connection affecting the use of their monitors, TVs, video cards, computers, laptops, etc. This was costly to the manufacturers and consumers alike, and with each new digital standard, rendered another expensive piece of electronic equipment obsolete.

The promulgation of digital standards in the computing and consumer electronics industries, including HDMI, HDTV, and DVI has created a problem for computer monitor and video card manufacturers. The VGA analog interface cannot fully accommodate the rich, multimedia signals that arise from products meeting these standards.

A new Unified Display Interface (UDI) is being designed to be an universal interface to replace VGA interface and remain compatible with HDMI and DVI. A UDI connector comprises a metal shell, an insulative housing received in the metal shell and with a plurality of contacts received therein, a plurality of cables respectively electrically connected with the contacts, a PVC housing over-molded to the shell and the cables. The insulative housing comprises a rectangular body portion, and a pair of lateral portions located at two side of the body portion. However, detailed structures of the UDI connector are not provided, such as the connection between the shell and insulative housing. And further, the UDI connector still has room to be improved for achieving perfect signal transmission effect or reaching reliable electrical and mechanical performances.

Hence, an electrical connector assembly is desired to overcome the disadvantage of the related arts.

SUMMARY OF THE INVENTION

Accordingly, the object of the present invention is to provide an electrical connector assembly for assuring a reliable connection between the components thereof.

Accordingly, another object of the present invention is to provide an electrical connector assembly for transmitting high-speed signals and reducing affect of EMI.

To achieve the above object, an electrical connector assembly in according with the present invention comprises a shielding shell defining a mating interface and a mating direction, a connector housing received in the shielding shell, a plurality of contacts received in the connector housing, a printed circuit board attached to the connector housing and electrically connected to the contacts, a cable comprising a plurality of conductors electrically attached to the printed circuit board, and a protecting cover surrounding the shielding shell, the printed circuit board and the cable. The connector housing comprises at least a stopper means formed on one end thereof for preventing the connector housing to be inserted excessively when the connector housing is assembled into the metal shell along the mating direction.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
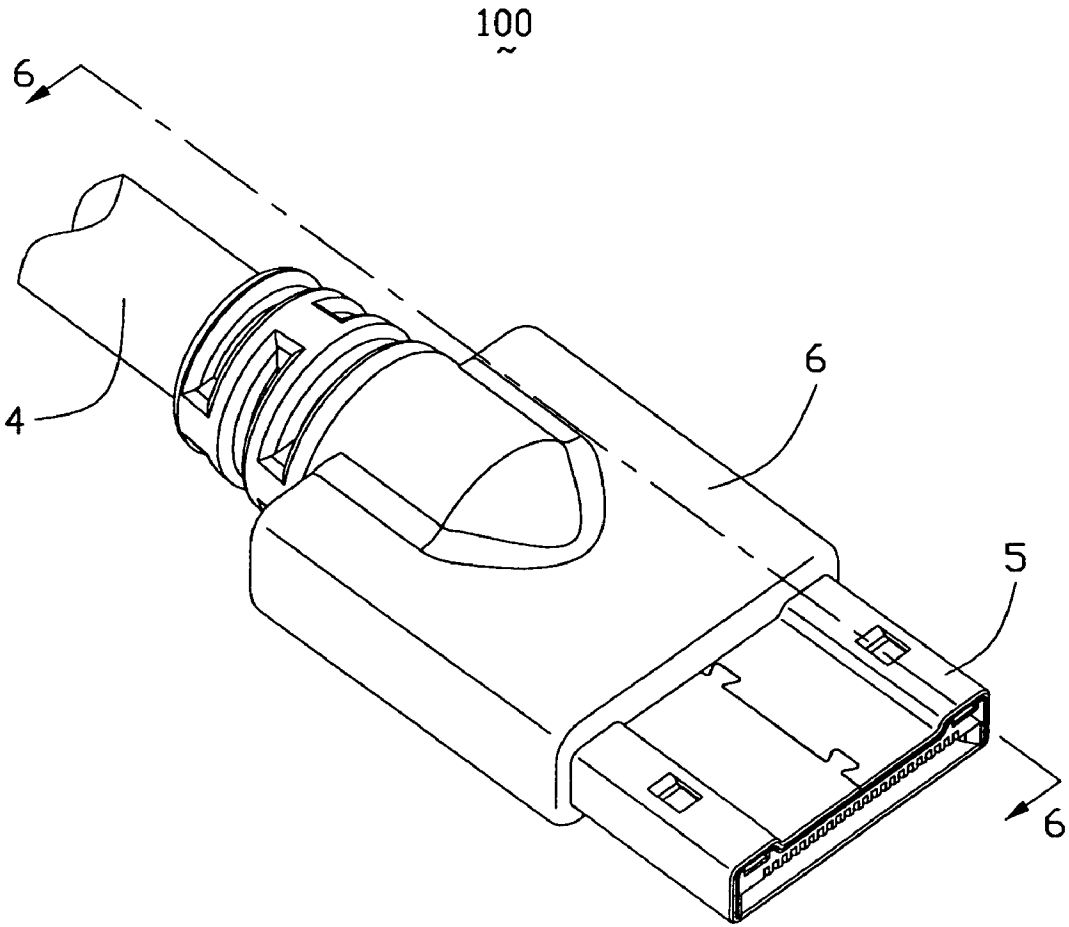
FIG. 1 is a perspective, assembled view of an electrical connector assembly in accordance with the present invention.
Figure 2:
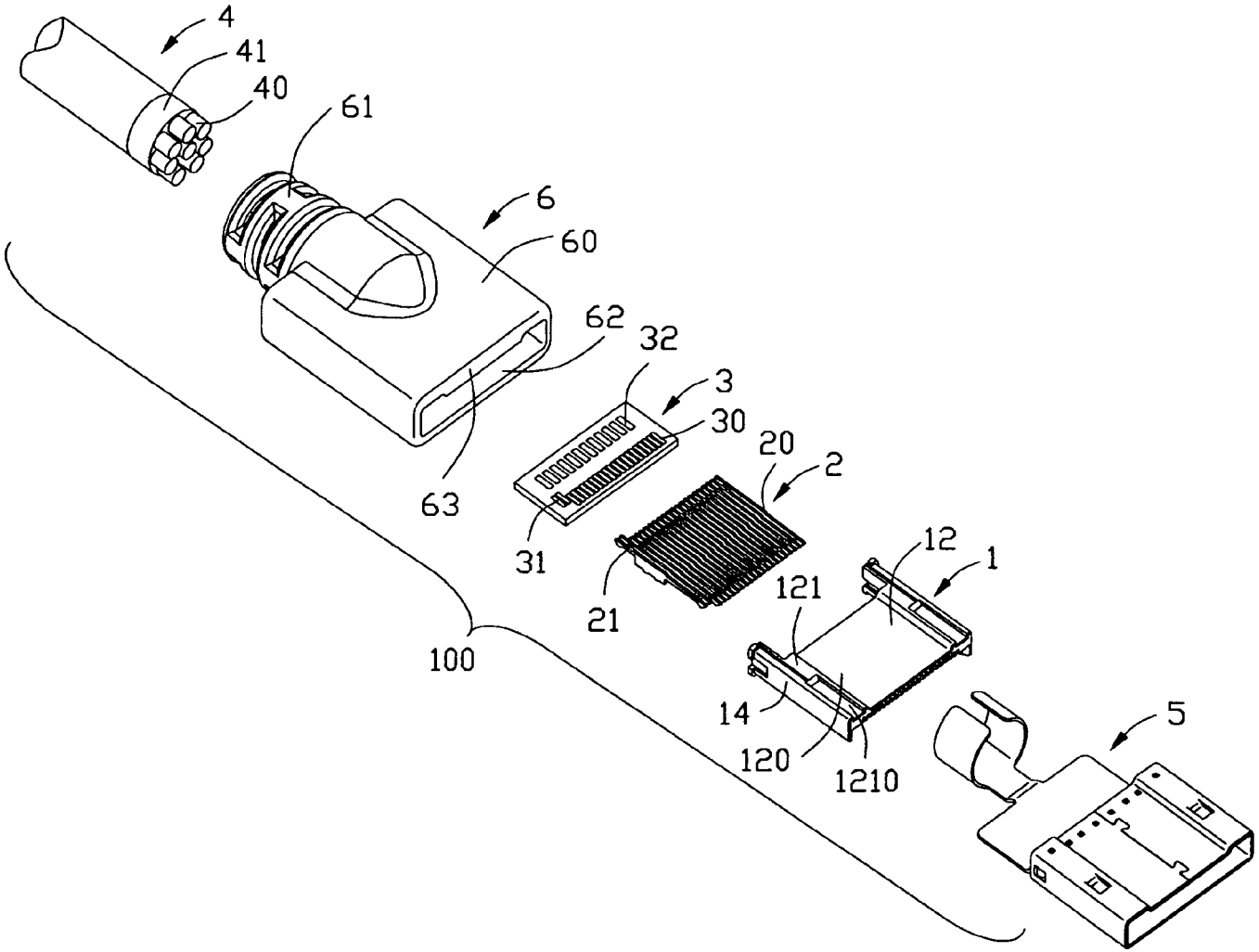
FIG. 2 is a perspective, exploded view of the electrical connector assembly of FIG. 1.
Figure 3:
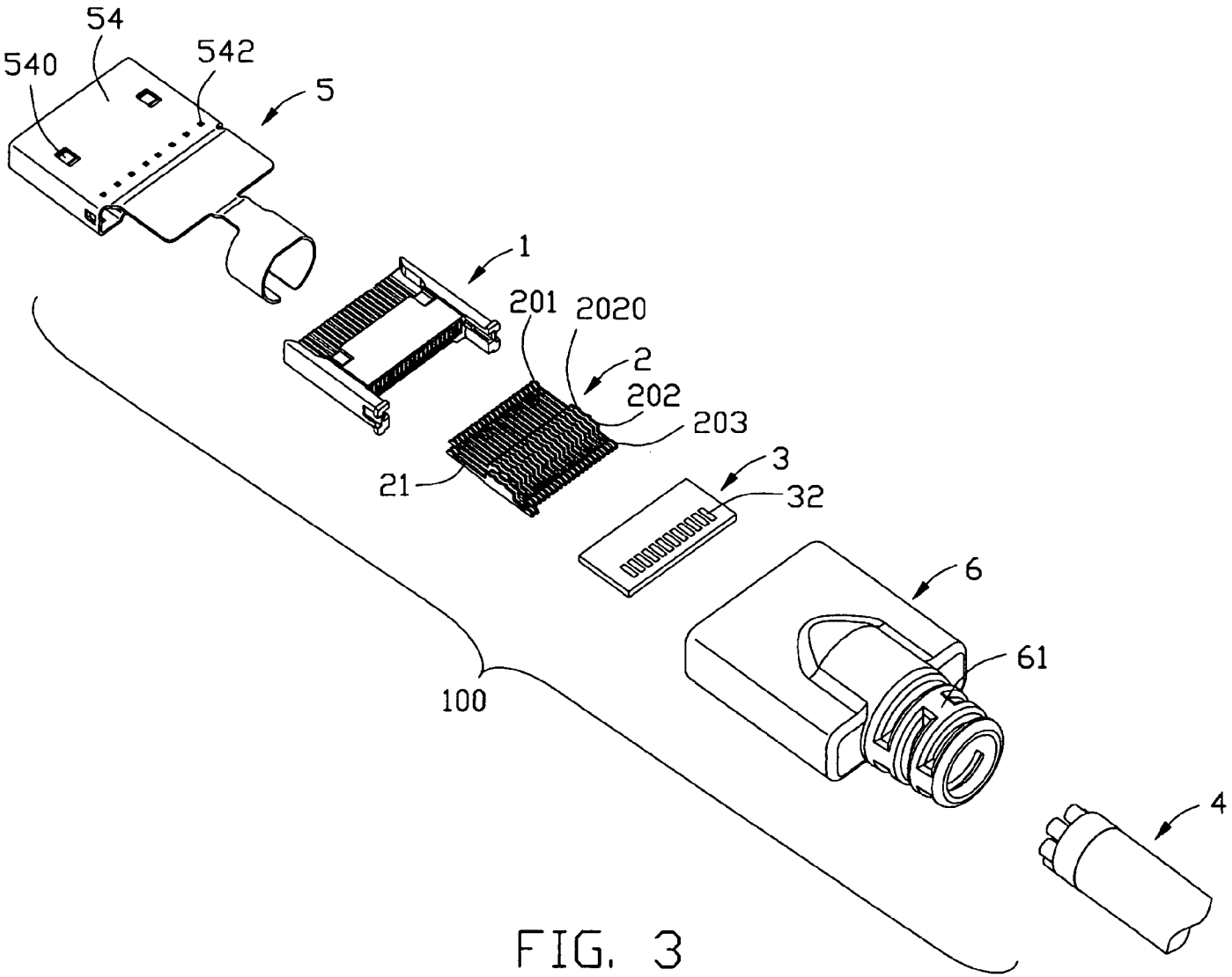
FIG. 3 is a view similar to FIG. 2, but taken from a different aspect.

Referring to FIGS. 1-3, an electrical connector assembly 100 in accordance with the present invention defines a mating direction and a mating interface, and comprises a connector housing 1 defining a receiving space (not labeled) for allowing a plurality of contacts 2 to be received therein, a printed circuit board 3 attached to the connector housing 1 and electrically connected to the contacts 2, a cable 4 electrically connected to the printed circuit board 3, a shielding shell 5 surrounding the connector housing 1 to provide the mating direction and the mating interface, and a protecting cover 6 partially enclosing the metal shell 5, the printed circuit board 3 and the cable 4.

Figure 4:
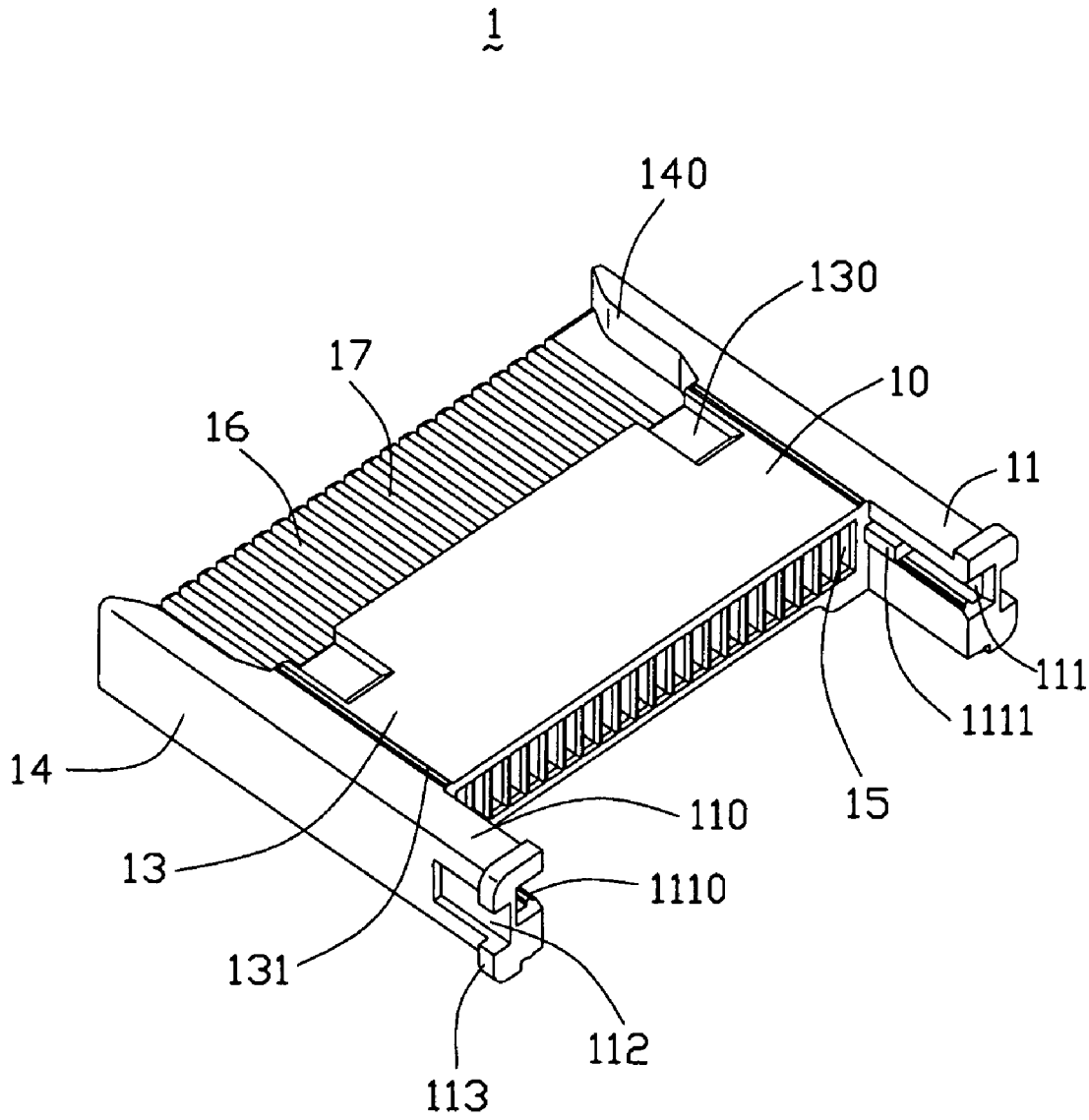
FIG. 4 is a perspective view of a connector housing of the electrical connector assembly in accordance with the present invention.

Referring to FIGS. 2-4, the connector housing 1 defines a base portion 10, and a connecting portion 11 integrally formed with the base portion 10 along the mating direction. The housing 1 is formed of an upper wall 12, a lower wall 13 extending parallel to the upper wall 12 and a pair of lateral walls 14 extending between the upper and lower walls 12, 13. The upper, lower and lateral walls 12, 13, 14 together define the receiving space and form a mating port with a U-shape configuration. In a preferred embodiment, the receiving space is divided into three parts, a plurality of passageways 15 defined between inner surfaces of the upper wall 12 and lower wall 13 and spaced from each other, a plurality of slot 16 formed in the inner surface of the upper wall 12 and communicated with corresponding passageways 15 along the mating direction, and an internal space 17 defined by the upper wall 12 and the pair of lateral walls 14, and respectively communicated with the passageways 15 and the slots 16. The upper wall 12 comprises a pair of lateral portions 121 respectively disposed adjacent to the lateral walls 14, and a generally flat part 120 disposed between the lateral portions 121 and depressed a predetermined distance relative to the lateral portion 121. Each lateral portion 121 comprises a first receiving slot 1210 depressed downwardly therefrom and rearwardly extending a given distance from a front surface thereof and stopped at a location adjacent to a rear surface thereof. The lower wall 13 is generally flat, and comprises a pair of second receiving slots 130 rearwardly extending a distance from a front surface thereof, and a pair of ribs 131 formed thereon with a dimension along the mating direction being same as that of the lower wall 13 for providing reliable connection when assembled to the shielding member 5. Each lateral wall 14 forms a guiding surface 140 by slantwise cutting a front portion thereof for guiding an insertion of a complementary connector. Further, the connecting portion 11 comprises a pair of extending bars 110 rearwardly extending from the lateral walls 14, and each extending bar 110 comprises a guiding slit 111 formed at the inner wall thereof for guiding an insertion of the printed circuit board 3, a securing slit 112 formed at the outer wall thereof, and a pair of stopper portions 113 symmetrically disposed at two sides of the securing slit 112 along a direction crossing the mating direction, and outwardly extending from the rear end of the extending bar 110. In a preferred embodiment, the stopper portions 113 are formed of reshape. The extending bar 110 further comprises a strip rib 1110 formed in the guiding slit 111 for reliably retaining the printed circuit board 3 therein, and a block 1111 formed one inner end of the guiding slit 111 for preventing the printed circuit board from being inserted excessively. In a preferred embodiment, the pair of stopper portions 113 functions as stopper means.

Referring to FIGS. 2-3, the contacts 3 comprise a plurality of first contacts 20, and a plurality of second contacts 21 all arranged side by side with predetermined interval. Each first contact 20 comprises a mating end 201 for mating with corresponding contact of the complementary connector, a tail end 203 having same shape as that of the mating end 201 for electrically connecting to the printed circuit board 3, and a retaining portion 202 connected the mating end 201 to the tail end 203. The retaining portion 202 comprises a plurality of stings 2020 formed on one edges thereof for interferentially engaging with inner surface of the passageways 15. The second contact 21 is same as the first contact 20 in structure, and is described as above.

Referring to FIGS. 2-3, the printed circuit board 3 is generally flat board, and comprises a plurality of first pads 30 formed on one surface and arranged in one row thereof for electrically connecting with the tail ends 203 of the first contacts 20, a plurality of second pads 31 formed adjacent to the first pads 30 for electrically connecting with the tail ends of the second contacts 21, and a plurality of third pads 32 formed on two surfaces thereof and respectively arranged in one row for electrically connecting with the cable 4. Noticeably, the first pads 30 are located beyond the second pads 31 along the mating direction. Additionally, the first and second pads 30, 31 are electrically connected with the third pads 32 by traces (not shown) formed on the printed circuit board 3.

Referring to FIG. 2, the cable 4 comprises a plurality of conductors 40 for soldering with the third pads 32, an insulator 41 surrounding the conductors 40 for providing a protection, and a grounding layer (not shown) electrically connected with the metal shell 5 for protecting against EMI.

Figure 5:
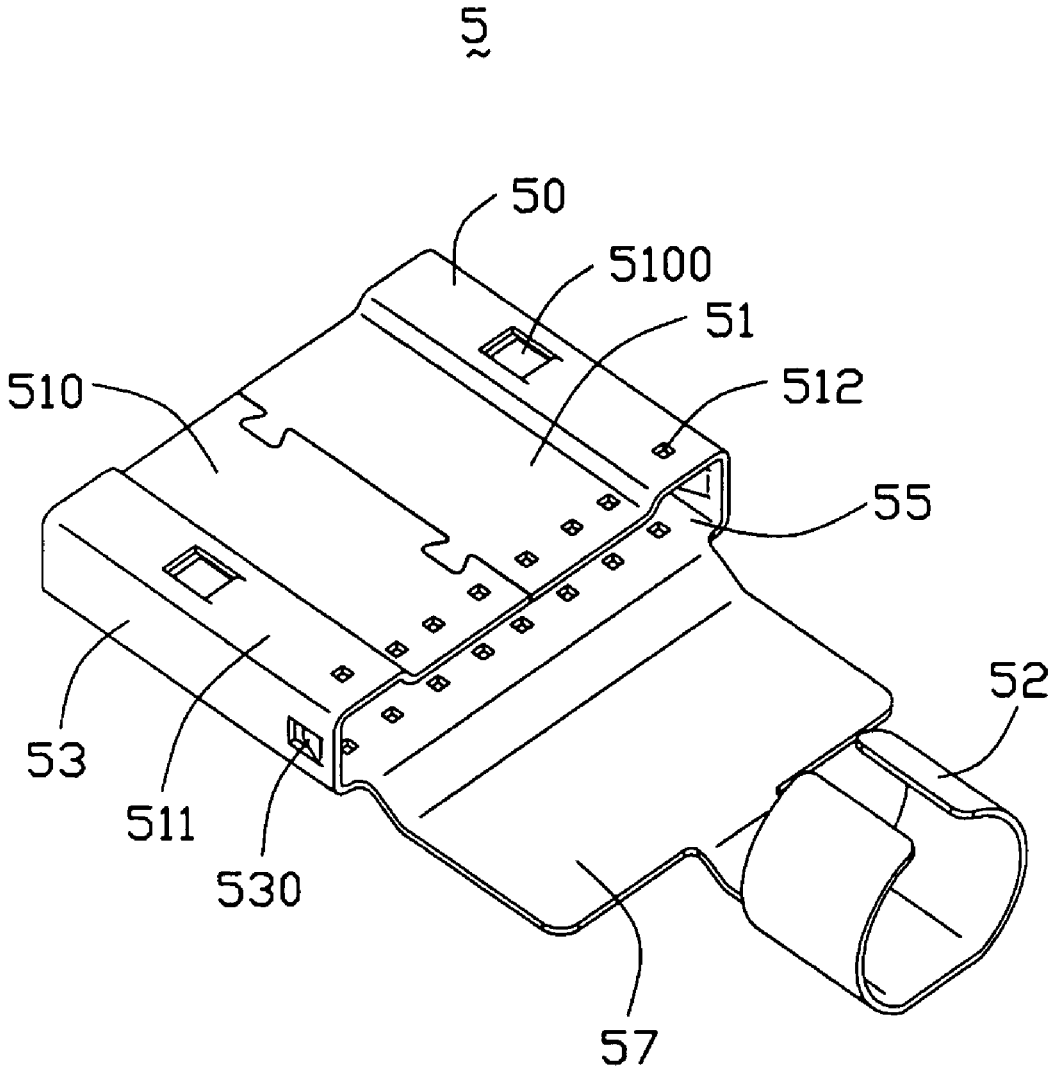
FIG. 5 is a perspective view of a shielding shell of the electrical connector assembly in accordance with the present invention.
Figure 6:
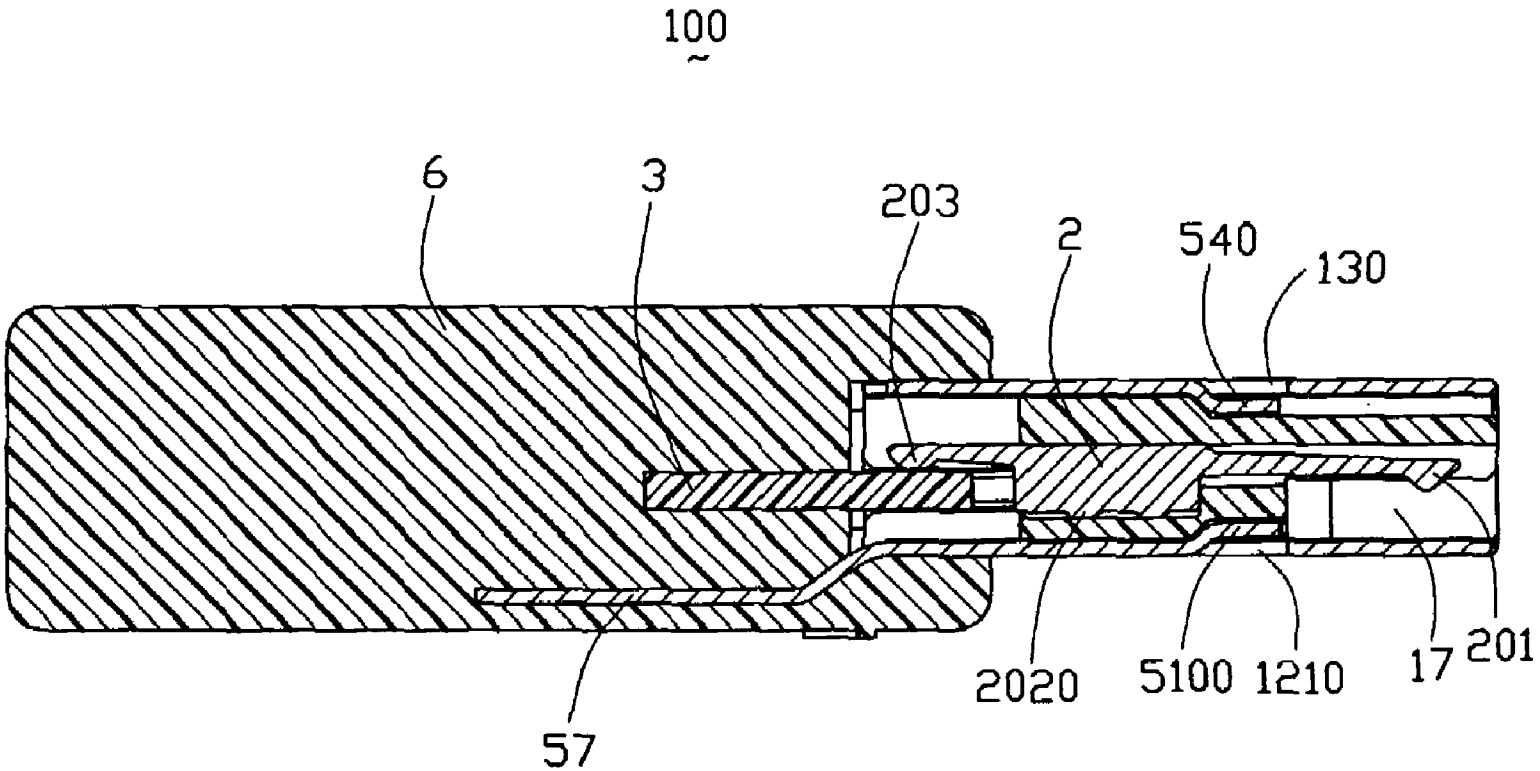
FIG. 6 is a cross-sectional view of FIG. 1 taken along line 6-6.

Referring to FIGS. 3-5, the shielding shell 5 is formed of one metal piece, and comprises a frame-shaped main portion 50, a general flat panel 57 rearwardly extending from the main portion 50, and a cable clamping portion 52 rearwardly extending from middle of a rear edge of the flat panel 57. The main portion 50 comprises a top wall 51, a bottom wall 54 opposite to the top wall 51, and a pair of sidewalls 53 connecting with the top wall 51 and the bottom wall 54. The top, bottom walls 51, 54 and sidewalls 53 together defines a receiving cavity 55 for receiving the connector housing 1 therein. The top wall 50 comprises a pair of lateral protruding portions 511 disposed in alignment with the lateral portion 121, and a flat portion 510 depressed towards the receiving cavity 55 and stepped relative to the lateral protruding portion 511 and aligned with the flat part 120. Each lateral protruding portion 511 forms a pair of first springs 5100 extending toward the receiving cavity 55 for sliding across the first receiving slots 1210 of the lateral portions 121 and preventing the shielding shell 5 to be pulled out from the connector housing 1. The bottom wall 54 comprises a pair of second springs 540 aligned with the second receiving slots 130. Each sidewall 53 comprises a third spring 530 formed adjacent to the rear surface thereof and aligned with the securing slit 112 for reliably fixing the connector housing 1 with the shielding shell 5. Both the top wall 51 and the bottom wall 54 all form a plurality of rectangular apertures 512, 542 located adjacent to the rear surface thereof.

Referring to FIGS. 2-3, the protecting cover 6 is formed of insulative material, and comprises a base portion 60, and a strain relief 61 rearwardly extending from the base portion 60. The base portion 60 defines a receiving hole 62 for partially receiving the printed circuit board 3, the connector housing 1 with the plurality of contacts 2 being received therein. The protecting cover 6 forms a projecting portion 63 projecting toward the receiving hole 62 and aligned with the flat portion 510. Noticeably, the projecting portion 63 is formed with a structure that can be received in the depressed flat portion 510.

Referring to FIGS. 1-6, in assembly, the first and second contacts 20, 21 are firstly and respectively inserted into the receiving space with the mating ends of the first and second contacts 20, 21 being respectively received in the slots 16, the retaining portions 202 of the first and second contacts 20, 21 being received in the passageways 15, and the tail ends of the first and second contacts 20, 21 exposed between the pair of the extending bars 110. Noticeably, the first and second contacts 20, 21 are reliably retained in the receiving space by an interferential fit manner between the stings 2020 of the first and second contacts 20, 21 and the inner surfaces of the passageways 15. And, the tip ends of the mating ends of the first contacts 21 are located more close to the mating interface than that of the second contacts 20 along the mating direction. Then, the printed circuit board 3 is inserted into, and engaged with the connector housing 1 due to a guiding of the guiding slit 111. During this insertion process, the tail ends of the first and second contacts 20, 21 are electrically connected to the first and second pads 30, 31, and the printed circuit board 3 is reliably retained in the guiding slits 111 by means of the strip rib 1110 abutting against one surface of the printed circuit board 3, and obstructed from being inserted excessively by the blocks 1111. For ensuring a reliable connection between the first and second pads 30, 31 and the tail ends of the first and second contacts 20, 21, the tail ends can be soldered with the pads 30, 31. Next, the cable 4 is soldered with the printed circuit board 3. The conductors 40 are respectively and electrically connected with the third pads 32.

Referring to FIGS. 1-6, after that, the above assembly is inserted into and assembled with the shielding shell 5 along the mating direction. During this assembly process, the connector housing 1 is received in the receiving cavity 55. Further, the pair of lateral portions 121 is putted into the lateral protruding portions 511 until the stopper means 113 is obstructed by the rear surface of the shielding member 5 with the first, second and third springs 5100, 540 and 530 are respectively and elastically abutting against the first, second receiving slots 1210, 130 and the securing slit 112 for holding the connector housing 1 in the shielding shell 5 and preventing the connector housing from 1 being pulled out. Then, the grounding layer of the cable 4 are clamped by the cable clamping portion 52 for fixing the cable 4 reliably with the shielding member 5 and achieving a grounding performance. Additionally, the ribs 131 of the connector housing 1 abut against one inner surface of the shielding shell 5 for providing an interferential fit therebetween.

Referring to FIGS. 1-6, finally, putting above assembly in a mold, and over-molding the protecting cover 6 on the above assembly. The melted material is injected, and forms the protecting cover 6 after cooling process. The protecting cover 6 encloses the rear end of the shielding shell 5, the printed circuit board 3, the joints between the conductors 40 and the third pads 32, and the front end of the cable 4 for providing sheath. The projecting portion 63 engages with the flat portion 510. Further, the melted material flows into the apertures 512, 542 of the shielding member 5, after cooled, the connector housing 1 can reliably retained with the protecting cover 6 by an interferential fit.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly, comprising:

a shielding shell defining a mating interface and a mating direction;

a connector housing received in the shielding shell;

a plurality of contacts received in the connector housing;

a printed circuit board attached to the connector housing and electrically connected to the contacts;

a cable comprising a plurality of conductors electrically attached to the printed circuit board; and a protecting cover surrounding the shielding shell, the printed circuit board and the cable;

wherein the connector housing comprises stopper means formed on one end thereof for preventing the connector housing to be inserted excessively when the connector housing is assembled into the shielding shell along the mating direction; and wherein the connector housing comprises an upper wall, a lower all, and a pair of lateral walls, thereby together defining a receiving space; and wherein the upper wall comprises a pair of lateral portions and a generally flat portion disposed between the lateral portions and depressed a distance relative to the lateral portion.

2. The electrical connector assembly as described in claim 1, wherein the connector housing comprises a base portion, and a pair of extending bars rearwardly extending from the base portion, the stopper means are respectively formed on the extending bars.

3. The electrical connector assembly as described in claim 2, wherein the stopper means is formed of Γ-shape and extending outwardly from the extending bar for abutting against at least a peripheral surface of the metal shell.

4. The electrical connector assembly as described in claim 3, wherein each extending bar comprises a guiding slit formed in inner surface thereof for guiding an insertion of the printed circuit board.

5. The electrical connector assembly as described in claim 1, wherein the shielding shell comprises a plurality of springs inwardly extending from one wall thereof, the connector housing comprises a plurality of slots respectively aligned with the springs, the springs are retained in the slots when the connector housing is inserted into the shielding shell along the mating direction for providing unmating force between the connector housing and the shielding shell.

6. The electrical connector assembly as described in claim 1, wherein the metal shell comprises a pair of lateral protruding portions for receiving the lateral portions of the connector housing therein, and a flat portion stepped relative to the lateral protruding portion and aligned with the flat portion of the connector housing.

7. The electrical connector assembly as described in claim 6, wherein each lateral portion comprises a receiving slot rearwardly extending from a front surface thereof and stopped at a location adjacent to a rear surface thereof, wherein the metal shell comprises a spring sliding along the receiving slot and elastically abutting against the receiving slot when the connector housing is assembled into the metal shell along the mating direction.

8. The electrical connector assembly as described in claim 1, wherein the connector housing comprises a base portion, and a connecting portion, the connecting portion comprises a securing slit formed at two lateral walls thereof, the metal shell comprises a spring inwardly extending from one lateral wall thereof and retained in the securing slit for preventing the connector housing from being pulled out from the metal shell.

9. The electrical connector assembly as described in claim 1, wherein the protecting cover is molded with the metal shell.

10. The electrical connector assembly as described in claim 9, wherein the metal shell comprises a plurality of apertures located adjacent to a rear edge thereof for providing an interference fit when the protecting cover is molded with the metal shell.

11. The electrical connector assembly as described in claim 10, wherein the metal shell comprises a main portion, a general flat panel rearwardly extending from the main portion, and a cable clamping portion, the cable clamping portion electrically clamps a grounding layer of the cable for achieving a grounding path and preventing EMI (Electro Magnetic Interference).

12. The electrical connector assembly as described in claim 1, wherein the contacts comprises a plurality of first contacts and a plurality of second contacts all arranged side by side, one tip ends of the first contacts are located more close to the mating interface than that of the second contacts along the mating direction.

13. An electrical connector assembly, comprising:

a metal shell defining a rear-to-front direction, and comprising a receiving cavity;

a housing received in the receiving cavity, and defining a mating port and a connecting port rearwardly extending from the mating port;

a plurality of contacts received in the housing, and each comprising a mating end located in the mating port for mating with a complementary connector, and a tail end opposite to the mating end;

a printed circuit board assembled to the housing along the rear-to-front direction, and electrically connected to the tail end of the contacts;

a cable comprising a plurality of conductors electrically connected to the printed circuit board for establishing an electrical connection between the electrical connector assembly and the complementary connector; and a protecting cover molded with the metal shell, and enclosing the printed circuit board and the front end of the cable therein; wherein the metal shell and the housing together define retaining means for preventing the metal shell from escaping from the housing; wherein the housing comprises stopper means formed at one edge thereof for abutting against one rear surface of the metal shell for preventing the housing to be inserted excessively.

14. The electrical connector assembly as described in claim 13, wherein the retaining means is formed of a plurality of slots formed in the housing, and a plurality springs inwardly extending from at least an outer surface of the metal shell toward the receiving cavity and retained in the slots.

15. The electrical connector assembly as described in claim 14, wherein the housing comprises stopper means formed at one edge thereof for abutting against one rear surface of the metal shell for preventing the housing to be inserted excessively.

16. The electrical connector assembly as described in claim 13, wherein the housing comprises a pair of lateral walls and an upper wall, these walls together defines the mating port with a U-shape configuration.

17. The electrical connector assembly as claimed in claim 16, wherein the mating port of the housing faces one wall of the metal shell.

18. The electrical connector assembly as described in claim 13, wherein the metal shell comprises a plurality of apertures formed adjacent to one rear edge thereof; the melted plastic material flues into the apertures and provides an interference fit between the metal shell and the protecting cover during a process to mold the protecting cover on the metal shell.

19. The assembly as claimed in claim 13, wherein the retaining means is formed of a plurality of slots formed in the housing, and a plurality springs inwardly extending from at least an outer surface of the metal shell toward the receiving cavity and retained in the slots.

* * * * *